US007822377B2

(12) United States Patent
Liu

(10) Patent No.: US 7,822,377 B2
(45) Date of Patent: Oct. 26, 2010

(54) COVER ASSEMBLY OF IMAGE CAPTURING DEVICE

(75) Inventor: Ju Liu, Suzhou (CN)

(73) Assignee: Avision Inc. (TW)

( * ) Notice: Subject to any disclaimer, the term of this patent is extended or adjusted under 35 U.S.C. 154(b) by 753 days.

(21) Appl. No.: 11/790,023

(22) Filed: Apr. 23, 2007

(65) Prior Publication Data

US 2007/0292182 A1 Dec. 20, 2007

(30) Foreign Application Priority Data

Jun. 15, 2006 (TW) ..... 95121387 A

(51) Int. Cl.
*G03G 15/00* (2006.01)

(52) U.S. Cl. ..... 399/380

(58) Field of Classification Search ..... 399/379, 399/380

See application file for complete search history.

(56) References Cited

U.S. PATENT DOCUMENTS 3,288,047 A * 11/1966 Limberger ..... 355/100
4,774,780 A * 10/1988 Crowell ..... 40/124.08
7,338,039 B2 * 3/2008 Pfau et al. ..... 267/144
2005/0286922 A1 * 12/2005 Oki ..... 399/75

FOREIGN PATENT DOCUMENTS

JP 02061632 A * 3/1990

* cited by examiner

*Primary Examiner*—Ren Yan
*Assistant Examiner*—Allister Primo

(57) ABSTRACT

A cover assembly of an image capturing device is provided. The image capturing device includes a housing having a platen for supporting the document. The cover assembly includes a buffer, a background sheet and a stretching-compressing mechanism. The cover is pivotally connected to the housing and has an inner surface facing the platen. The buffer is disposed on the inner surface, and the background sheet is disposed on the buffer. The stretching-compressing mechanism connects the buffer and the inner surface for being compressed or stretched to apply a force on the buffer and the background sheet to make the buffer and the background sheet press the document on the platen or to make an end of each of the background sheet and the buffer part raised from the document and the other parts of the background sheet and the buffer press the document on the platen.

11 Claims, 2 Drawing Sheets

COVER ASSEMBLY OF IMAGE CAPTURING DEVICE

This application claims the benefit of Taiwan application Serial No. 95121387, filed Jun. 15, 2006, the subject matter of which is incorporated herein by reference.

BACKGROUND OF THE INVENTION

1. Field of the Invention

The invention relates in general to a cover assembly of an image capturing device, and more particularly to a cover assembly of an image capturing device capable of preventing the document placed on the platen of the image capturing device from adhering to the cover when the cover of the image capturing device is opened.

2. Description of the Related Art

A conventional image capturing device, such as a scanner, usually includes a cover, a sponge body, a background sheet, a housing and a scanning unit. The cover is pivotally connected to the housing through a pivot so that the cover can be opened and closed relative to the housing. The scanning unit is disposed inside the housing and is for scanning a document placed on a platen of the housing.

Before the document is scanned, the document is placed on the platen of the housing, and the cover is closed relative to the housing to clamp the document. Thus, the sponge body and the background sheet attached to the cover tightly press the document on the platen of the housing. The sponge body and the background sheet are compressed, and a vacuumed space between the background sheet and the document is created. Next, the document is scanned so that the image of the document is captured.

However, when the scan is completed and the cover is opened, the document would adhere to the background sheet and move with the cover due to the vacuumed space therebetween; consequently, the document cannot be easily replaced or the document may drop from the background sheet and cover and get soiled.

In addition, there is one type of conventional copier which comprises a cover having a front portion and a rear portion connected together, where the rear portion is hinged to the housing of the copier. When the user wants to lift the cover, the front portion close to the user will be pulled up first, and then the rear portion is subsequently lifted up. However, the cover having the two portions cannot be used when the machine, for example, like the scanner, multi-function peripheral or copier, has the automatic document feeder (ADF) disposed on the cover. So, all the conventional image capturing devices having the cover and the housing may encounter the above-mentioned problems.

SUMMARY OF THE INVENTION

The invention is directed to a cover assembly of an image capturing device. A stretching-compressing mechanism disposed between an inner side of a cover of the cover assembly and a buffer of the cover assembly can be used to prevent the cover from attracting a document and thus prevent the document placed on the platen of the image capturing device from adhering to the cover and moving or flying away when the cover of the image capturing device is opened. Consequently, it is possible to facilitate the replacement of the document and to prevent the document from dropping and thus getting soiled.

According to the present invention, a cover assembly of an image capturing device is provided. The cover assembly is for preventing a cover from attracting a document and thus preventing the document placed on the platen of the image capturing device from adhering to the cover and moving or flying away when the cover of the cover assembly of the image capturing device is opened. The image capturing device further includes a housing having a platen for supporting the document. The cover assembly further includes a buffer, a background sheet and a stretching-compressing mechanism. The cover is pivotally connected to the housing and has an inner surface facing the platen. The buffer is disposed on the inner surface, and the background sheet is disposed on the buffer. The stretching-compressing mechanism is disposed between the buffer and the inner surface and connects the buffer to the inner surface. The stretching-compressing mechanism is compressed or stretched to apply a force on the buffer and the background sheet. When the cover and the housing are closed, the stretching-compressing mechanism is compressed to apply the force on the buffer and the background sheet such that the buffer and the background sheet may press the document on the platen. When the cover is opened relative to the housing at an angle, an end of each of the background sheet and the buffer is moved away from the platen and the stretching-compressing mechanism is stretched to apply the force on the background sheet and the buffer, such that the background sheet and the buffer may partially press the document on the platen.

The invention will become apparent from the following detailed description of the preferred but non-limiting embodiments. The following description is made with reference to the accompanying drawings.

DETAILED DESCRIPTION OF THE INVENTION

Figure 1:
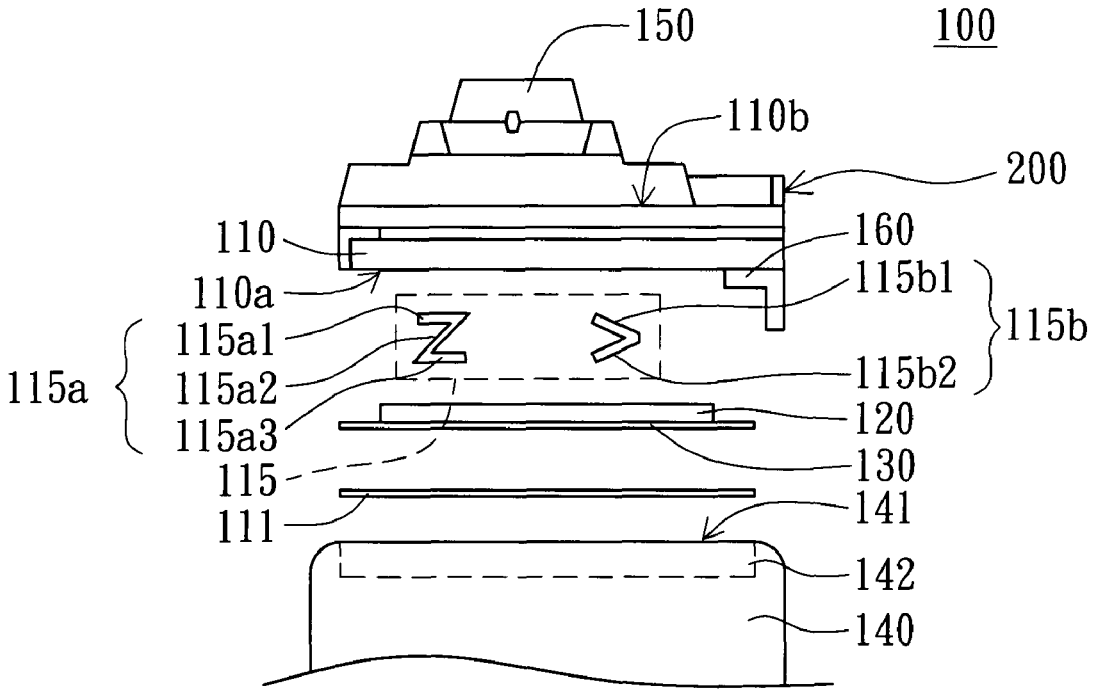
FIG. 1 is an exploded side view showing an image capturing device according to a preferred embodiment of the invention.
Figure 2:
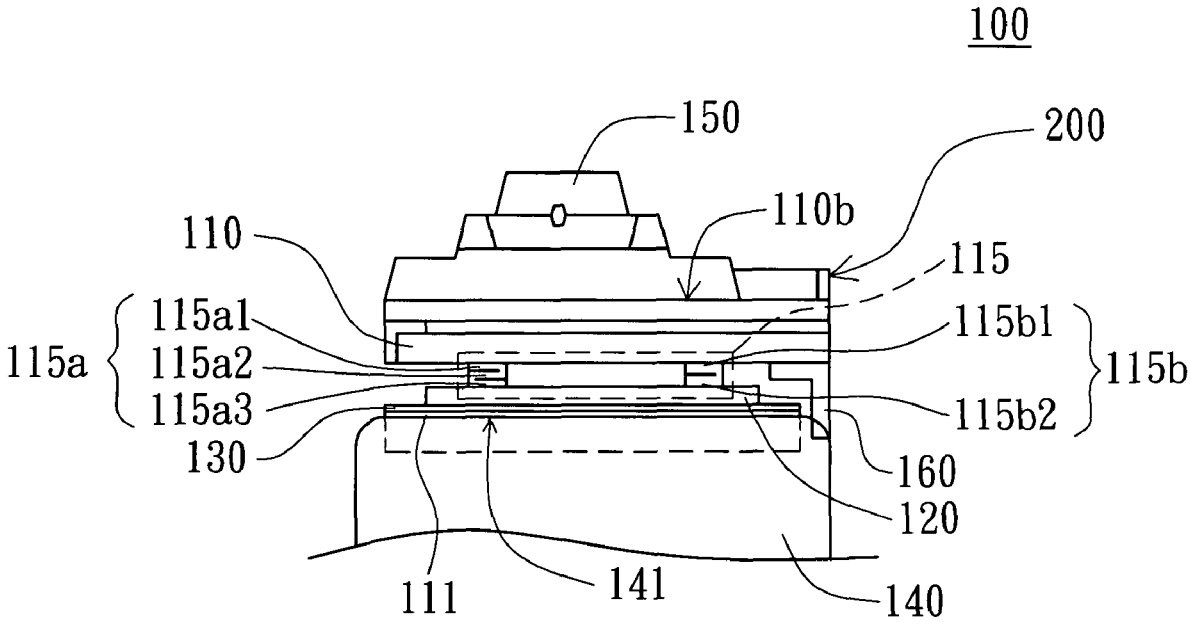
FIG. 2 is an assembled side view showing a state in which a cover and a housing in FIG. 1 are closed.
Figure 3:
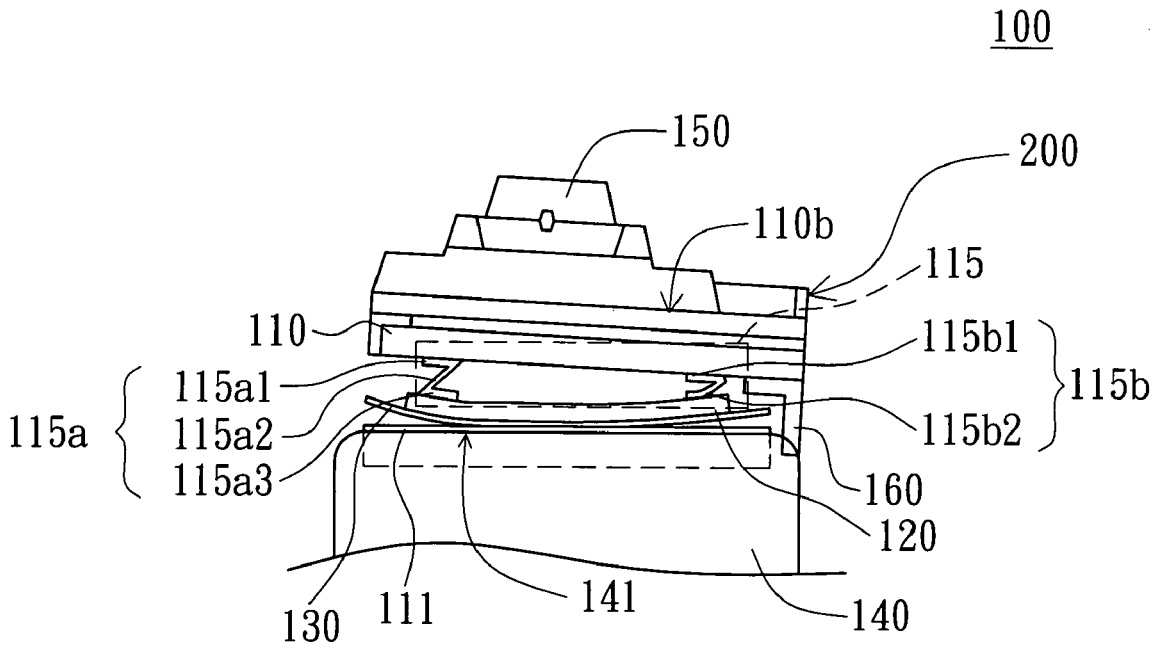
FIG. 3 is a schematic illustration showing a state in which the cover and the housing in FIG. 2 are slightly opened.
Figure 4:
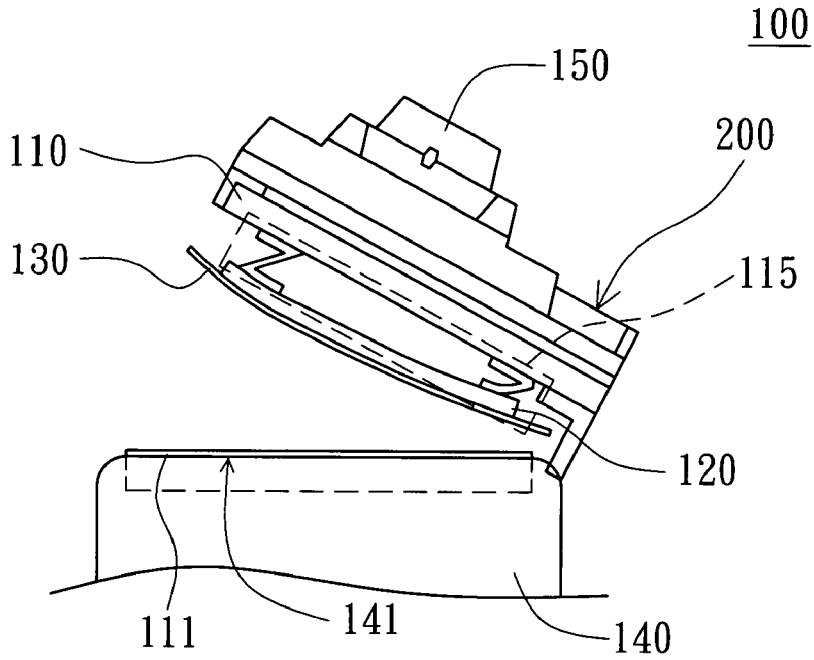
FIG. 4 is a schematic illustration showing a state in which the cover and the housing in FIG. 3 are completely opened.

FIG. 1 is an exploded side view showing an image capturing device 100 according to a preferred embodiment of the invention. FIG. 2 is an assembled side view showing a state in which a cover and a housing in FIG. 1 are closed. FIG. 3 is a schematic illustration showing a state in which the cover and the housing in FIG. 2 are slightly opened. FIG. 4 is a schematic illustration showing a state in which the cover and the housing in FIG. 3 are completely opened. Referring to FIGS. 1 to 4, the image capturing device 100 for capturing an image of a document 111 includes a housing 140 and a cover assembly 200. The cover assembly 200 includes a cover 110, a buffer 120, a background sheet 130 and a stretching-compressing mechanism 115. The housing 140 has a platen 141 for supporting the document 111. The cover 110 is pivotally connected to the housing 140 and has an inner surface 110*a* facing the platen 141. The buffer 120 is disposed on the inner surface 110*a* and faces the housing 140. The background sheet 130 is disposed on the buffer 120. The stretching-compressing mechanism 115 is disposed between the buffer 120 and the inner surface 110*a* and connects the buffer 120 and the inner surface 110*a*. The stretching-compressing mechanism is compressed or stretched to apply a force on the buffer and the background sheet As shown in FIG. 2, when the cover 110 is closed relative to the housing 140, the stretching-compressing mechanism 115 is compressed to apply the force on the buffer 120 and the background sheet 130 such that the buffer and the background sheet may press the document 111 on the platen 141.

As shown in FIG. 3, when the cover 110 is opened relative to the housing 140 at a first angle, where when an end of each of the background sheet 130 and the buffer 120 is moved away from the platen 141, the stretching-compressing mechanism 115 is stretched. At this time, the background sheet 130 and the buffer 120 may partially press the document 111 on the platen 141. Consequently, it is possible to prevent the document 111 from adhering to the cover, or moving or flying away when the cover 110 is opened.

As shown in FIG. 4, when the cover 110 is opened relative to the housing 140 at a second angle greater than the first angle, where the background sheet 130 and the buffer 120 are completely raised from the platen 141, so the user can replace the document 111.

In the invention, it is possible to prevent the cover 110 from drawing the document 111 and thus to prevent the document 111 from moving or flying away when the cover 110 of the image capturing device 100 is opened according to the design of the stretching-compressing mechanism 115 between the inner side of the cover 110 and the buffer 120 in the cover assembly 200. Consequently, the document can be replaced conveniently, and the document is free from dropping and thus is kept from getting soiled.

Referring to FIG. 1, the image capturing device 100 of this embodiment further includes a pivot 160 for pivotally connecting an end of the cover 110 to an end of the housing 140 so that the cover 110 is pivotally connected to the housing 140. Thus, the cover 110 can be rotated relative to the housing 140 and can be opened and closed relative to the housing 140. In addition, the stretching-compressing mechanism 115 includes, without limitation to, a first pleated sheet 115*a* and a second pleated sheet 115*b*. The first pleated sheet 115*a* includes a first attaching portion 115*a*1, a connection portion 115*a*2 and a second attaching portion 115*a*3. The connection portion 115*a*2 connects the first attaching portion 115*a*1 to the second attaching portion 115*a*3. The first attaching portion 115*a*1 and the second attaching portion 115*a*3 are respectively attached to an end of the inner surface 110*a* and an end of the buffer 120. Thus, the first pleated sheet 115*a* can be spreadably connected to an end of each of the cover 110 and the buffer 120. For example, the first attaching portion 115*a*1 and the second attaching portion 115*a*3 are respectively attached to the end of the inner surface 110*a* and the end of the buffer 120 through an adhesive agent. The second pleated sheet 115*b* is disposed between the pivot 160 and the first pleated sheet 115*a* and has a third attaching portion 115*b* and a fourth attaching portion 115*b*2. The third attaching portion 115*b*1 and the fourth attaching portion 115*b*2 are respectively attached to the other end of the inner surface 110*a* and the other end of the buffer 120. Thus, the second pleated sheet 115*b* is spreadably connected to the other ends of the cover 110 and the buffer 120. For example, the third attaching portion 115*b*1 and the fourth attaching portion 115*b*2 are respectively attached to the other ends of the inner surface 110*a* and the buffer 120 through the adhesive agent, and the fourth attaching portion 115*b*2 may be partially attached to the other end of the buffer 120.

As shown in FIG. 2, when the cover 110 is closed relative to the housing 140, the stretching-compressing mechanism 115 is compressed, and the first pleated sheet 115*a* and the second pleated sheet 115*b* do not spread out. The first attaching portion 115*a*1, the connection portion 115*a*2 and the second attaching portion 115*a*3 are in close contact with one another, and the third attaching portion 115*b* and the fourth attaching portion 115*b*2 are in close contact with each other.

As shown in FIG. 3, when the user starts to lift up the cover 110 and the cover 110 is rotated by the first angle relative to the housing 140, the stretching-compressing mechanism 115 is stretched, the first pleated sheet 115*a* and the second pleated sheet 115*b* slightly spread out. The first attaching portion 115*a*1 and the second attaching portion 115*a*3 reversely spread out relative to the connection portion 115*a*2 to make the first pleated sheet 115*a* represent a Z-shaped structure, and the third attaching portion 115*b*1 and the fourth attaching portion 115*b*2 slightly spread out to make the second pleated sheet 115*b* represent a V-shaped structure. At this time, the end of the background sheet 130 and the end of the buffer 120 are raised from the document 111, and the other parts of the background sheet 130 and the buffer 120 press the document 111 on the platen 141. Because the background sheet 130 and the buffer 120 are softer, the user can pull up the cover 110 at the end farthest away from the pivot 160 while leaving the document 111 on the platen 141.

As shown in FIG. 4, when the user continues lifting the cover 110 to make the cover 110 rotate by the second angle relative to the housing 140, the buffer 120 and the background sheet 130, due to a gravity force and a centrifugal force around the pivot, pull the first pleated sheet 115*a* and the second pleated sheet 115*b* and enable the first pleated sheet and the second pleated sheet to spread out, and the buffer 120 and the background sheet 130 form an outwardly arced structure with respect to the cover.

However, it can be understood for one of ordinary skill in the art that the technology of the embodiment is not limited thereto. For example, the stretching-compressing mechanism 115 may be an elastic member or a hinge mechanism. For example, the stretching-compressing mechanism 115 includes a first elastic member connecting one end of the inner surface 110*a* to one end of the buffer 120, and a second elastic member connecting the opposite ends of the inner surface 110*a* and the buffer 120 and disposed between the pivot 160 and the first elastic member. The first elastic member and the second elastic member may have the same or different elasticity. The first elastic member and the second elastic member may be a combination of a spring and an elastic sheet. In addition, the image capturing device 100 further includes a scanning unit 142, which is disposed in the housing 140, for capturing the image of the document 111. In addition, the cover 110 has an outer surface 110*b* formed on the opposite side of the cover with respect to the inner surface 110*a*, and the cover assembly 200 further includes an automatic document feeder (ADF) 150, which is disposed on the outer surface 110*b*. The buffer 120 may be made of sponge, rubber or a porous material to achieve the buffering function. The background sheet 130 may be white or black according to the requirement on the background. The image capturing device 100 may be used in a copier, a scanner, a fax machine or a multi-function peripheral.

The image capturing device according to the embodiment of the invention advantageously eliminates the phenomenon of the document adhering to the cover when the cover is opened relative to the housing and thus solves the problem of the document moving or flying away. Thus, the invention facilitates the replacement of the document on the image capturing device, and effectively prevents the document from dropping and getting soiled.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A cover assembly of an image capturing device, the image capturing device comprising a housing having a platen for supporting a document, the cover assembly comprising:

a cover pivotally connected at an inner end to the housing and having an inner surface facing the platen;

a buffer disposed on the inner surface of the cover;

a flexible background sheet disposed on the buffer; and a stretching-compressing mechanism disposed between the buffer and the inner surface and connecting the buffer to the inner surface, wherein the stretching-compressing mechanism is compressed or stretched to apply a force on the buffer and the background sheet, the stretching-compressing mechanism comprising at least two elastic members with different elasticities connecting the inner surface to the buffer at the inner end and an outer end of the cover, respectively, wherein the one of the at least two elastic members positioned closer to the inner end has a lower elasticity than that of the other of the at least two elastic members.

2. The cover assembly according to claim 1, wherein when the cover is closed relative to the housing, the stretching-compressing mechanism is compressed to apply the force on the buffer and the background sheet such that the buffer and the background sheet press the document on the platen; and when the cover is opened relative to the housing at a first angle, an end of each of the background sheet and the buffer is moved away from the platen and the stretching-compressing mechanism is stretched to apply the force on the background sheet and the buffer, such that the background sheet and the buffer partially press the document on the platen.

3. The cover assembly according to claim 2, wherein when the cover is opened relative to the housing at a second angle greater than the first angle, the background sheet and the buffer are completely raised from platen.

4. The cover assembly according to claim 1, wherein the image capturing device further comprises:

a pivot for pivotally connecting an end of the cover to an end of the housing to make the cover rotatable relative to the housing.

5. The cover assembly according to claim 1, wherein:

the first elastic member comprises a first pleated sheet having a first attaching portion, a connection portion and a second attaching portion, wherein the connection portion connects the first attaching portion to the second attaching portion, and the first attaching portion and the second attaching portion are respectively attached to an end of the inner surface and an end of the buffer; and the second elastic member comprises a second pleated sheet having a third attaching portion and a fourth attaching portion respectively attached to the other end of the inner surface and the other end of the buffer.

6. The cover assembly according to claim 5, wherein:

when the stretching-compressing mechanism is compressed, the first attaching portion, the connection portion and the second attaching portion are in close contact with one another, and the third attaching portion and the fourth attaching portion are in close contact with each other; and when the stretching-compressing mechanism is stretched, the first attaching portion and the second attaching portion spread out relative to the connection portion so that the first pleated sheet has a Z-shaped structure, and the third attaching portion and the fourth attaching portion spread out relative to each other so that the second pleated sheet has a V-shaped structure.

7. The cover assembly according to claim 5, wherein when the cover is opened relative to the housing, the buffer and the background sheet pull the first pleated sheet and the second pleated sheet and enable the first pleated sheet and the second pleated sheet to spread out, and the buffer and the background sheet form an outwardly arced structure with respect to the cover.

8. The cover assembly according to claim 1, wherein the image capturing device further comprises:

a scanning unit, disposed in the housing, for capturing an image of the document.

9. The cover assembly according to claim 1, wherein the cover has an outer surface formed on the opposite side of the cover with respect to the inner surface, and the cover assembly further comprises:

an automatic document feeder (ADF) disposed on the outer surface.

10. The cover assembly according to claim 1, wherein the buffer is made of sponge, rubber or a porous material.

11. The cover assembly according to claim 1, wherein the image capturing device is a copier, a scanner, a fax machine or a multi-function peripheral.

* * * * *